US008826500B2

(12) United States Patent
Sato

(10) Patent No.: US 8,826,500 B2
(45) Date of Patent: Sep. 9, 2014

(54) SLIDE FASTENER

(75) Inventor: Hideki Sato, Toyama (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 13/816,263

(22) PCT Filed: Aug. 11, 2010

(86) PCT No.: PCT/JP2010/063664

§ 371 (c)(1),
(2), (4) Date: Feb. 11, 2013

(87) PCT Pub. No.: WO2012/020489

PCT Pub. Date: Feb. 16, 2012

(65) Prior Publication Data

US 2013/0139364 A1 Jun. 6, 2013

(51) Int. Cl.
*A44B 19/28* (2006.01)
*A44B 19/30* (2006.01)

(52) U.S. Cl.
CPC ..... *A44B 19/303* (2013.01); *A44B 19/28* (2013.01)
USPC ..... 24/427; 24/429

(58) Field of Classification Search
USPC ..... 24/415, 416, 427, 428, 436, 429
See application file for complete search history.

(56) References Cited

U.S. PATENT DOCUMENTS 2,355,987 A 8/1944 Marinsky et al.
2,438,614 A 3/1948 Morin
2,455,178 A * 11/1948 Jones ..... 24/418
2,575,501 A * 11/1951 Ulrich ..... 24/404
2,596,861 A 5/1952 Meech
2,681,490 A 6/1954 Okolowicz
2,875,490 A * 3/1959 Sinclair ..... 24/436
2,879,573 A 3/1959 Ulrich
2,937,427 A 5/1960 Mikulas
RE25,223 E 8/1962 Mikulas
3,530,549 A * 9/1970 Manchester, Jr. ..... 24/404

(Continued)

FOREIGN PATENT DOCUMENTS

JP 37-32712 Y1 12/1962
JP 49-70740 A 7/1974

(Continued)

OTHER PUBLICATIONS

International Preliminary Report on Patentability, PCT Application No. PCT/JP2010/063664, mailed Mar. 12, 2013.

(Continued)

*Primary Examiner* — Robert J Sandy
*Assistant Examiner* — Abigail Morrell
(74) *Attorney, Agent, or Firm* — Kilpatrick Townsend & Stockton LLP

(57) ABSTRACT

There is provided a slide fastener that includes a pair of fastener stringers provided with fastener element rows having a plurality of fastener elements along opposing tape-side edges of a pair of fastener tapes, and a slider slidably attached to the fastener element rows to engage and disengage the fastener elements. One of the fastener stringers is separated from the slider when a lateral pulling force directed outward in a width direction of the fastener tapes is applied to the pair of fastener stringers. The upper blade and the lower blade of the slider are provided with cutaway portions at portions outward in the width direction from one lateral surface of the guide post.

4 Claims, 12 Drawing Sheets

(56) References Cited

U.S. PATENT DOCUMENTS

| | | | | | |
|---|---|---|---|---|---|
| 3,818,549 | A | | 6/1974 | Moertel | |
| 3,872,551 | A | | 3/1975 | Moertel | |
| 3,872,553 | A | * | 3/1975 | Moertel | 24/428 |
| 4,129,928 | A | | 12/1978 | Sugiyama et al. | |
| 4,409,705 | A | | 10/1983 | Yuunaga | |
| 4,521,942 | A | | 6/1985 | Oda | |
| 4,562,622 | A | | 1/1986 | Takabatake | |
| 4,590,648 | A | * | 5/1986 | Yoshida et al. | 24/415 |
| 5,007,144 | A | * | 4/1991 | Terada et al. | 24/415 |
| 5,528,802 | A | | 6/1996 | Akashi | |
| 5,664,300 | A | | 9/1997 | Mizuno | |
| 5,898,979 | A | | 5/1999 | Hamada | |
| 5,901,420 | A | | 5/1999 | Oda | |
| 6,481,068 | B1 | | 11/2002 | Takasawa | |
| 6,530,132 | B2 | | 3/2003 | Yamagishi et al. | |
| 6,775,885 | B1 | | 8/2004 | Wang | |
| 7,802,347 | B2 | | 9/2010 | Tachi et al. | |
| 2004/0055119 | A1 | | 3/2004 | Keyaki et al. | |
| 2009/0049659 | A1 | | 2/2009 | Takani et al. | |
| 2013/0139362 | A1 | | 6/2013 | Sato | |
| 2013/0139363 | A1 | | 6/2013 | Sato | |
| 2013/0139365 | A1 | | 6/2013 | Sato | |

FOREIGN PATENT DOCUMENTS

| | | | |
|---|---|---|---|
| JP | 98808/1983 | A | 7/1983 |
| JP | 39011/1989 | | 3/1989 |
| JP | 8-19407 | A | 1/1996 |
| JP | 10-327911 | A | 12/1998 |
| JP | 2001-95608 | A | 4/2001 |
| JP | 2002-101917 | A | 4/2002 |
| JP | 2004-105570 | A | 4/2004 |
| JP | 2008-36280 | A | 2/2008 |
| JP | 2009-45226 | A | 3/2009 |
| TW | M258627 | | 3/2005 |
| WO | 2010/113275 | A1 | 10/2010 |

OTHER PUBLICATIONS

Office Action, Japanese Patent Application No. 2012-528542, mailed Nov. 12, 2013.
Office Action, Japanese Patent Application No. 2012-528544, mailed Nov. 12, 2013.
International Search Report, PCT Application No. PCT/JP2010/063665, mailed Nov. 16, 2010.
International Search Report, PCT Application No. PCT/JP2010/063666, mailed Nov. 16, 2010.
International Search Report, PCT Application No. PCT/JP2010/061061, mailed Aug. 2, 2011.
International Preliminary Report on Patentability, PCT Application No. PCT/JP2010/063665, mailed Mar. 12, 2013.
International Preliminary Report on Patentability, PCT Application No. PCT/JP2010/063666, mailed Mar. 12, 2013.
International Preliminary Report on Patentability, PCT Application No. PCT/JP2011/061061, mailed Mar. 12, 2013.
Office Action, Taiwanese Patent Application No. 100105150, mailed Jul. 8, 2013.
Office Action, Taiwanese Patent Application No. 100105151, mailed Jul. 8, 2013.
International Search Report, PCT Application No. PCT/JP2010/063664, mailed Nov. 22, 2010.
Final Office Action, U.S. Appl. No. 13/816,238, mailed Feb. 14, 2014.
Notice of Allowance, U.S. Appl. No. 13/816,245, mailed Feb. 12, 2014.
Notice of Allowance, U.S. Appl. No. 13/816,335, mailed Feb. 12, 2014.
Non-Final Office Action, U.S. Appl. No. 13/816,238, mailed Aug. 13, 2013, 11 pages.
Non-Final Office Action, U.S. Appl. No. 13/816,245, mailed Aug. 2, 2013, 8 pages.
Non-Final Office Action, U.S. Appl. No. 13/816,335, mailed Aug. 2, 2013, 10 pages.

* cited by examiner

SLIDE FASTENER

This application is a national stage application of PCT/JP2010/063664 which is incorporated herein by reference.

TECHNICAL FIELD

The present invention relates to a slide fastener, and more particularly, to a slide fastener, in which if a lateral pulling force is applied to a pair of fastener stringers, one of the fastener stringers is separated from a slider.

BACKGROUND ART

As is known in the related art, a slide fastener includes an upper blade having a double structure consisting of an inner plate and an outer plate, in which the outer plate is released from the inner plate by pulling down a pull tab in one side, so that one of fastener stringers is separated from a slider (e.g., see Patent Document 1).

PRIOR ART DOCUMENT

Patent Document

Patent Document 1: U.S. Pat. No. 2,681,490

SUMMARY OF INVENTION

Problems to Be Solved by Invention

In the slide fastener disclosed in Patent Document 1, since the upper blade has the double structure consisting of the inner plate and the outer plate, its construction is complicated, and thus a manufacturing cost thereof can be increased.

The present invention has been made in view of the above-described problem, and an object of the present invention is to provide a slide fastener capable of easily separating one of the fastener stringers from a slider with a simple structure.

Means for Solving Problems

The above object of the present invention can be achieved by the following configuration.

(1) A slide fastener including a pair of fastener stringers provided with fastener element rows having a plurality of fastener elements along opposing tape-side edges of a pair of fastener tapes; and a slider slidably attached to the fastener element rows to engage and disengage the fastener elements, wherein one of the fastener stringers is separated from the slider when a lateral pulling force directed outward in a width direction of the fastener tapes is applied to the pair of fastener stringers, wherein the slider includes: a body having an upper blade and a lower blade which are disposed in parallel while being spaced apart from each other in an up-down direction, a guide post connecting the upper blade and the lower blade at front ends thereof, flanges each provided along both left and right edges of the upper blade and the lower blade, and a pull tab attachment portion provided on an upper surface of the upper blade; and a pull tab rotatably attached to the pull tab attachment portion, and wherein the upper blade and the lower blade are provided with cutaway portions at portions outward in the width direction from one lateral surface of the guide post.

(2) The slide fastener according to the configuration of the above (1), wherein the cutaway portions are formed so as to extend outward in the width direction from one lateral surface of the guide post.

(3) The slide fastener according to the configuration of the above (1) or (2), wherein a length, in a longitudinal direction, of the flanges at one side of the body in the width direction is shorter than that of the flanges at another side of the body in the width direction.

(4) The slide fastener according to the configuration of any one of the above (1) to (3), wherein a distance, in a longitudinal direction, between a rear end of the guide post and front ends of the flanges at one side of the body in the width direction is shorter than a distance, in the longitudinal direction, between the rear end of the guide post and front ends of the flanges at another side of the body in the width direction.

Advantageous Effects of Invention

According to the slide fastener of the present invention, since the upper blade and the lower blade are provided with the cutaway portions at portions outward in the width direction from one lateral surface of the guide post, the one side of the upper blade and the lower blade with respect to the guide post can be easily bent. Accordingly, it is possible to easily separate one of the fastener stringers from the slider with the simple structure.

EMBODIMENTS OF INVENTION

Figure 1:
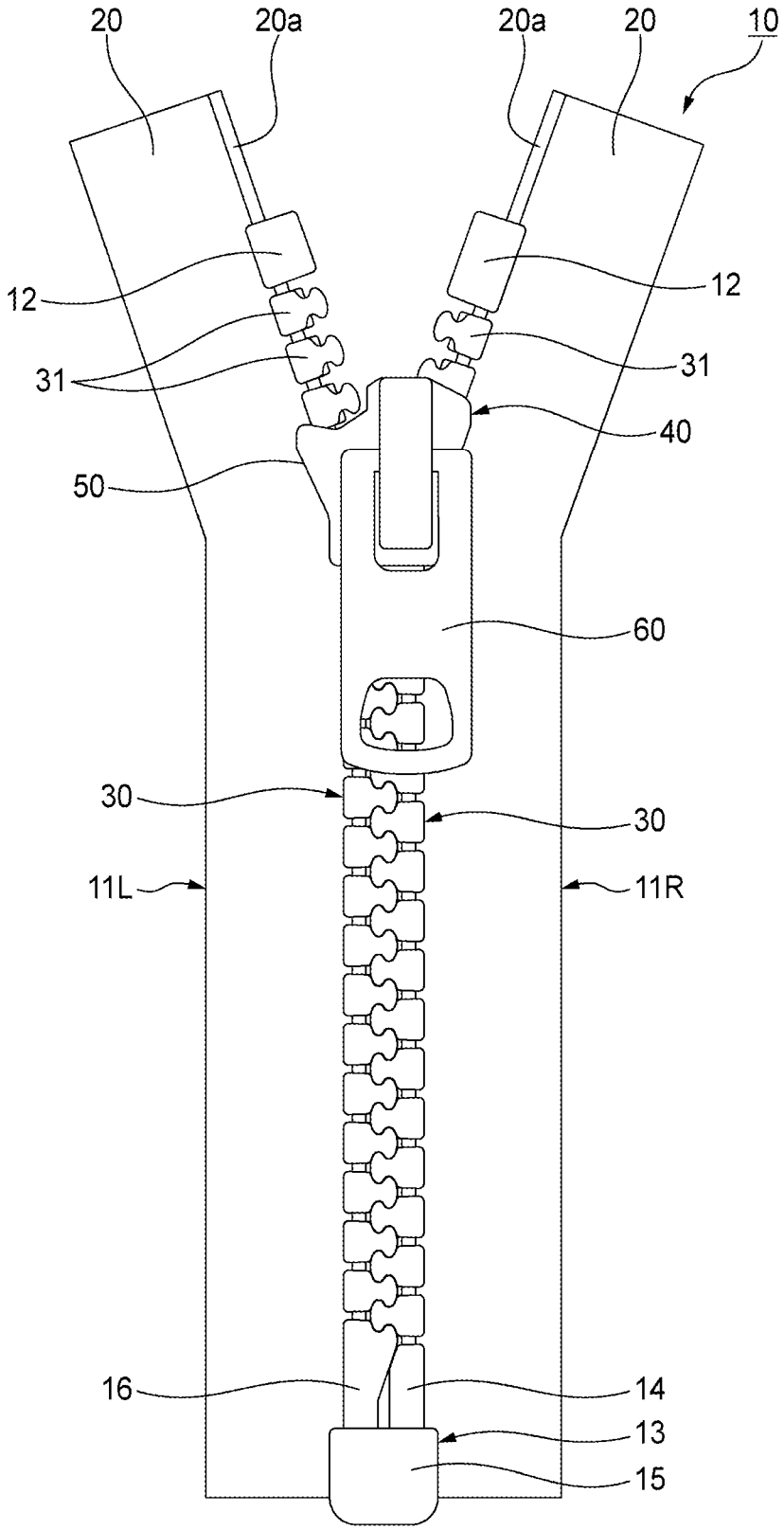
FIG. 1 is a front view of a slide fastener according to one embodiment of the present invention.

One embodiment of a slide fastener according to the present invention will now be described in detail with reference to the accompanying drawings. In the following description of the embodiment, as for a fastener tape, a front side refers to a near side with respect to a paper surface of FIG. 1;

a back side refers to a far side with respect to the paper surface of FIG. 1; an upper side refers to an upper side with respect to the paper surface of FIG. 1; a lower side refers to a lower side with respect to the paper surface of FIG. 1; a left side refers to a left side with respect to the paper surface of FIG. 1; and a right side refers to a right side with respect to the paper surface of FIG. 1. As for a slider, an upper side refers to a near side with respect to the paper surface of FIG. 1; a lower side refers to a far side with respect to the paper surface of FIG. 1; a front side refers to an upper side with respect to the paper surface of FIG. 1; a rear side refers to a lower side with respect to the paper surface of FIG. 1; a left side refers to a left side with respect to the paper surface of FIG. 1; and a right side refers to a right side with respect to the paper surface of FIG. 1. Also, a right and left direction of the fastener tapes and the slider is referred to as a width direction, and an up-down direction of the fastener tapes is referred to as a longitudinal direction.

Figure 6:
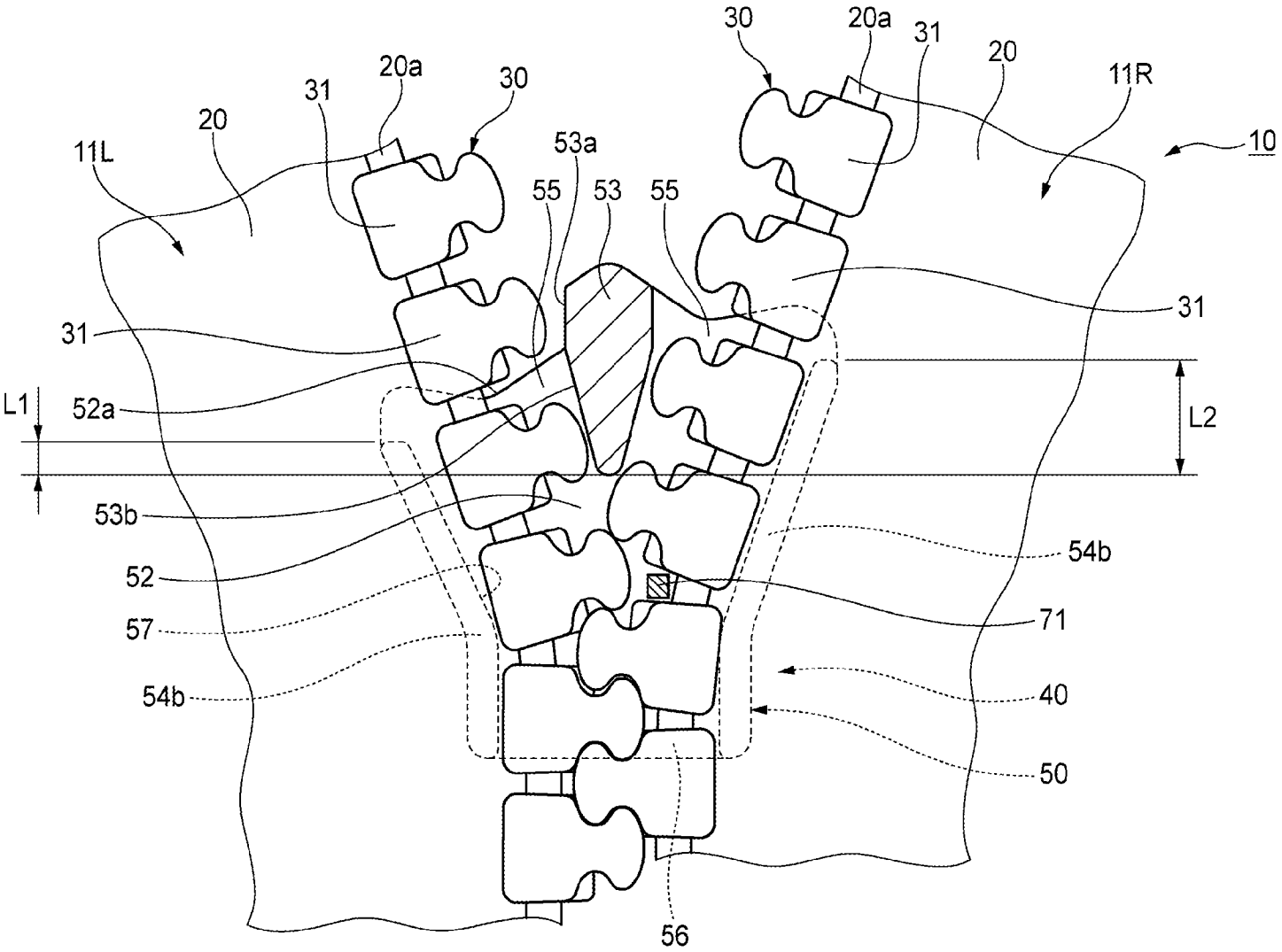
FIG. 6 is an enlarged front view of the slide fastener in which an upper blade is cut away.

As illustrated in FIGS. 1 and 6, a slide fastener 10 of this embodiment includes a pair of left and right fastener stringers 11L and 11R in which fastener element rows 30 having a plurality of fastener elements 31 are provided along opposing tape-side edges 20*a* of a pair of left and right fastener tapes 20, a slider 40 slidably attached to the fastener element rows 30 to engage and disengage the fastener elements 31, top end stops 12 each attached to upper end portions of the tape-side edges 20*a* of the pair of left and right fastener tapes 20, and separable end stop 13 formed at lower end portions of the tape-side edges 20*a* of the pair of left and right fastener tapes 20.

The separable end stop 13 includes a box pin 14 and a box body 15 which are formed at lower end portions of the tape-side edge 20*a* of the right fastener tape 20, and an insert pin 16 which is formed at the lower end portion of the tape-side edge 20*a* of the left fastener tape 20 and is able to be inserted into the box body 15. Also, in this embodiment, the left fastener stringer 11L provided with the insert pin 16 is a separation-side fastener stringer which is able to be detached from the slider 40, while the right fastener stringer 11R provided with the box pin 14 and the box body 15 is a stationary-side fastener stringer which is not able to be detached from the slider 40.

The fastener element rows 30 are comprised of the plurality of fastener elements 31 which are formed on the tape-side edges 20*a* of the fastener tapes 20 with injection molding using synthetic resin, for example, polyamide, polyacetal, polypropylene, or polybutylene terephthalate.

The slider 40 is a slider having an automatic stop function, as illustrated in FIGS. 2 to 6, and includes a body 50, a pull tab 60, a stopper claw body 70, and a pull tab holding cover 80.

The body 50 has an upper blade 51 and a lower blade 52 which are disposed in parallel while being spaced apart from each other in an up-down direction, a guide post 53 connecting the upper blade 51 and the lower blade 52 at front ends thereof and at a center portion in a width direction, upper flanges 54*a* protruding downward from both left and right edges of the upper blade 51, and lower flanges 54*b* protruding upward from both left and right edges of the lower blade 52. Accordingly, a front portion of the body 50 is provided with left and right shoulder mouths 55 which are separated by the guide post 53, and a rear portion of the body 50 is provided with a rear mouth 56. An approximately Y-shaped element guide passage 57 is formed between the upper blade 51 and the lower blade 52 to communicate the left and right shoulder mouth 55 and the rear mouth 56, and the element guide passage 57 forms a path through which the pair of left and right fastener element rows 30 are inserted.

Figure 4:
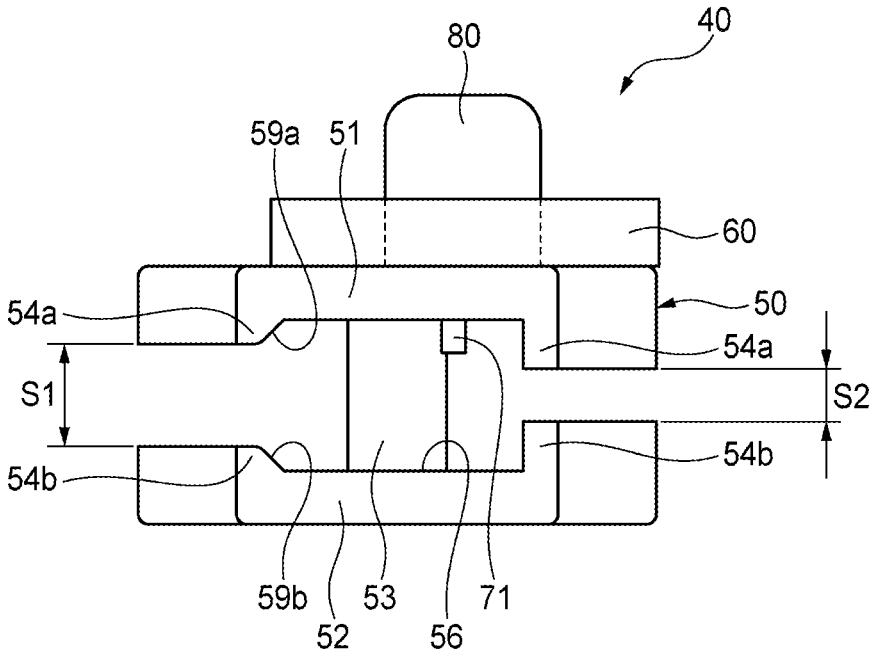
FIG. 4 is a rear view of the slider shown in FIG. 2, when seen from a rear mouth.

As illustrated in FIG. 4, a dimension S1 of a gap between the upper and lower flanges 54*a* and 54*b* at the left side of the body 50 in the up-down direction is set to be larger than a dimension S2 of a gap between the upper and lower flanges 54*a* and 54*b* at the right side in the up-down direction. Accordingly, the left fastener stringer 11L can be separated from the slider 40.

Figure 5:
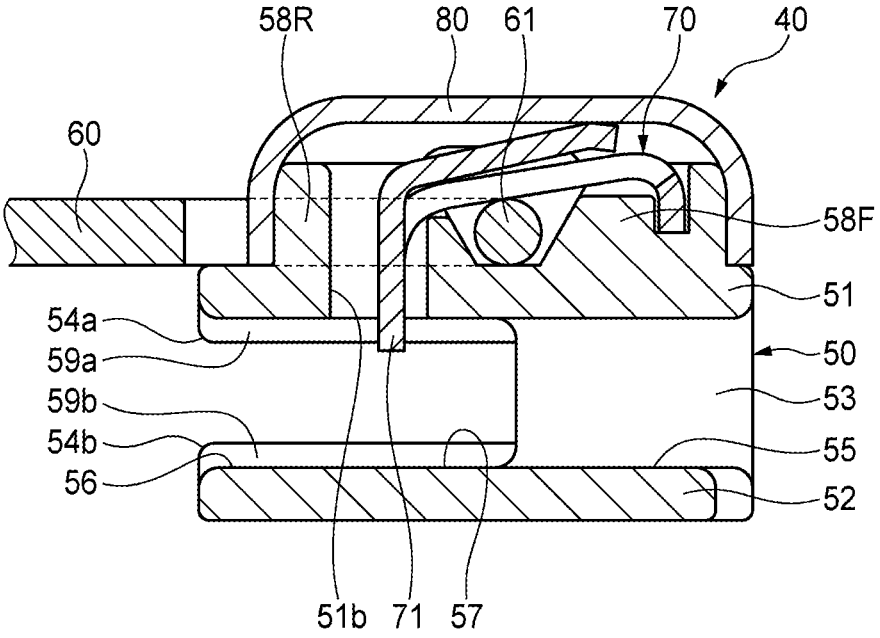
FIG. 5 is a cross-sectional view taken along the line A-A in FIG. 3.

The right side (a side of stationary-side fastener stringer 11R) of the upper surface of the upper blade 51 with respect to the guide post 53 in the width direction is provided with a front attachment post 58F and a rear attachment post 58R which are installed upright parallel with each other and arranged in a front and rear direction, to attach the pull tab holding cover 80 thereto. A link portion 61 of the pull tab 60 and the stopper claw body 70 are accommodated between the front attachment post 58F and the rear attachment post 58R, and the front attachment post 58F and the rear attachment post 58R are covered by the pull tab holding cover 80 and are fixed by crimping. Also, as illustrated in FIG. 5, the upper blade 51 is provided with a claw insertion hole 5 lb in which the a stopper claw 71 of the stopper claw body 70 is inserted. In this embodiment, a pull tab attachment portion is configured by the front attachment post 58F, the rear attachment post 58R, the stopper claw body 70, and the pull tab holding cover 80.

As described above, since the front attachment post 58F and the rear attachment post 58R are formed at the right side of the upper surface of the upper blade 51 with respect to the guide post 53 in the width direction, rigidity of the left side of the upper blade 51 with respect to the guide post 53 is slightly reduced, so that the left side of the upper blade 51 is likely to be bent. Accordingly, since the left side of the upper blade 51 can be easily bent, the separation-side fastener stringer 11L can be easily separated from the slider 40.

In addition, since the stopper claw body 70 is disposed at the right side of the upper surface of the upper blade 51 with respect to the guide post 53 in the width direction, as illustrated in FIG. 6, the stopper claw 71 of the stopper claw body 70 is inserted between the fastener elements 31 of the stationary-side fastener stringer 11R. Accordingly, since the stopper claw 71 does not contact with the fastener elements 31 of the separation-side fastener stringer 11L, it is possible to smoothly separate the separation-side fastener stringer 11L from the slider 40.

Figure 2:
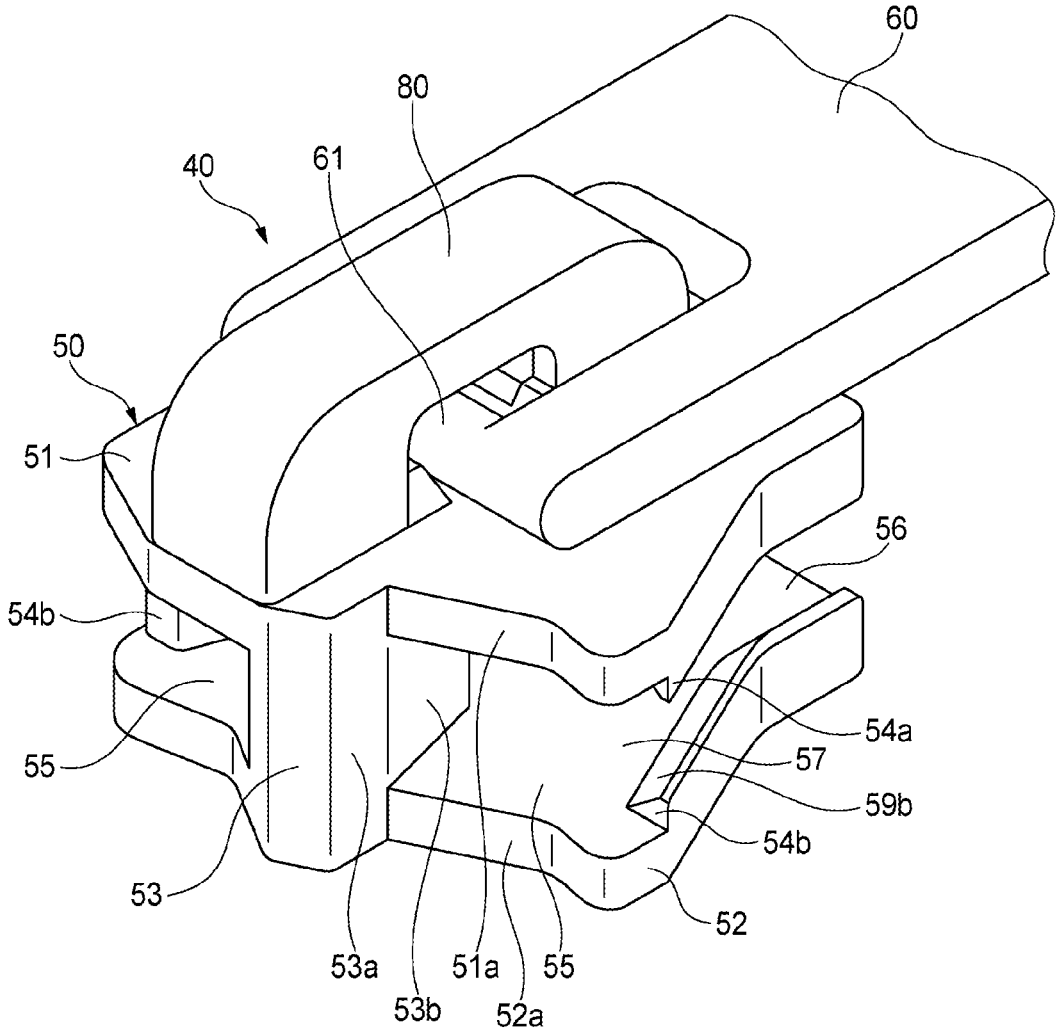
FIG. 2 is a perspective view of the slider shown in FIG. 1.
Figure 3:
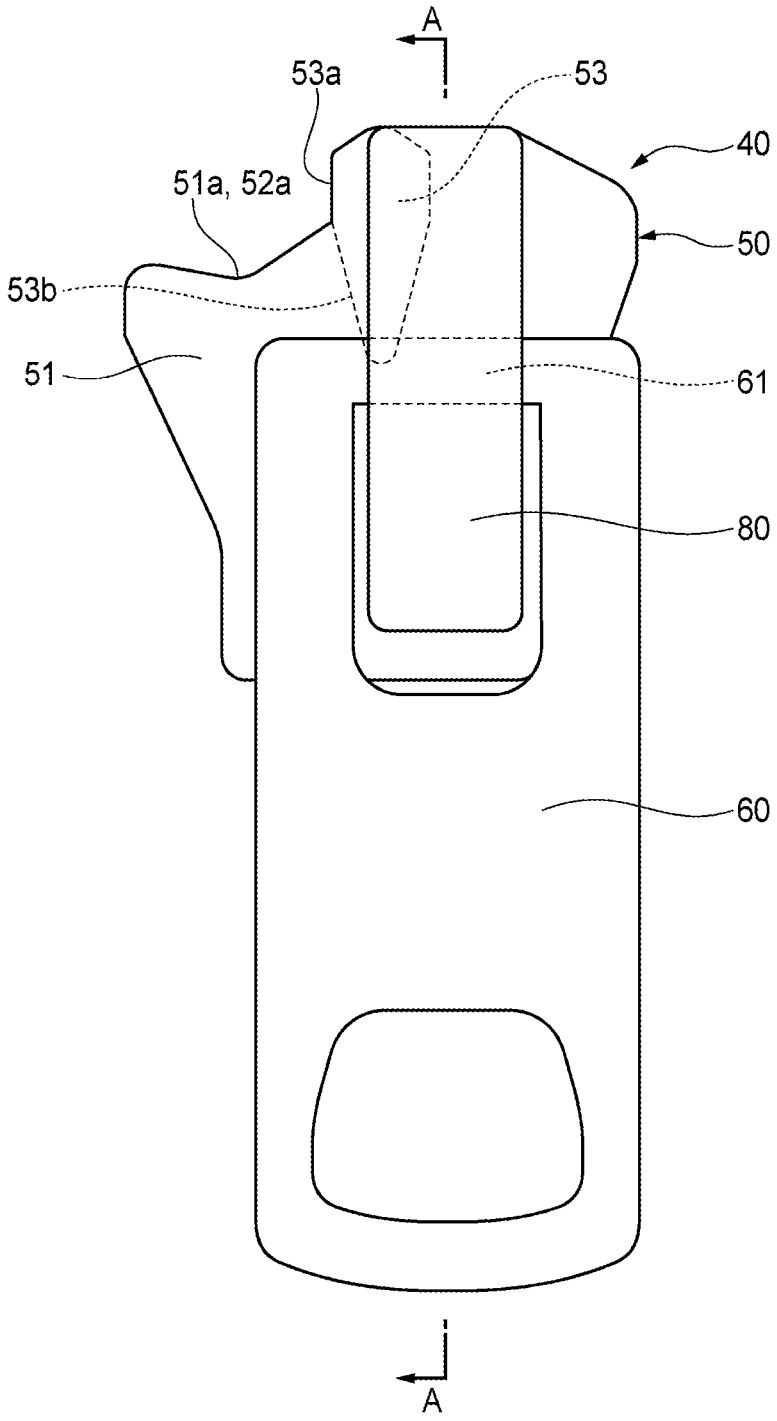
FIG. 3 is a plan view of the slider shown in FIG. 2.

As illustrated in FIGS. 2, 3 and 6, the upper blade 51 and the lower blade 52 are respectively provided with cutaway portions 51*a* and 52*a* extending outward (toward the separation-side fastener stringer 11L) in the width direction from a front lateral surface 53*a* at the left side of the guide post 53. Accordingly, a distance L1 between the rear end of the guide post 53 and the front ends of the upper and lower flanges at the left side of the body 50 in the longitudinal direction is shorter than a distance L2 between the rear end of the guide post 53 and the front ends of the upper and lower flanges at the right side of the body 50 in the longitudinal direction. For this reason, since a length of the upper and lower flanges 54*a* and 54*b* of the left side of the body 50 in the longitudinal direction is shorter than the upper and lower flanges 54*a* and 54*b* at the right side of the body 50, the rigidity of the left side of the upper blade 51 and the lower blade 52 with respect to the guide post 53 is slightly reduced, so that the left side of the upper blade 51 and the lower blade 52 are likely to be bent. Accordingly, since the left side of the upper blade 51 and the lower blade 52 can be easily bent, the separation-side fastener stringer 11L can be easily separated from the slider 40.

The cutaway portions 51*a* and 52*a* extend outward in the width direction and rearward in an oblique manner from a boundary between the front lateral surface 53*a* and the rear lateral surface 53*b* at the left side of the guide post 53. The cutaway portions 51*a* and 52*a* are then bent at about an intermediate portion, and extend outward in the width direction and forward in an oblique manner.

Figure 11:
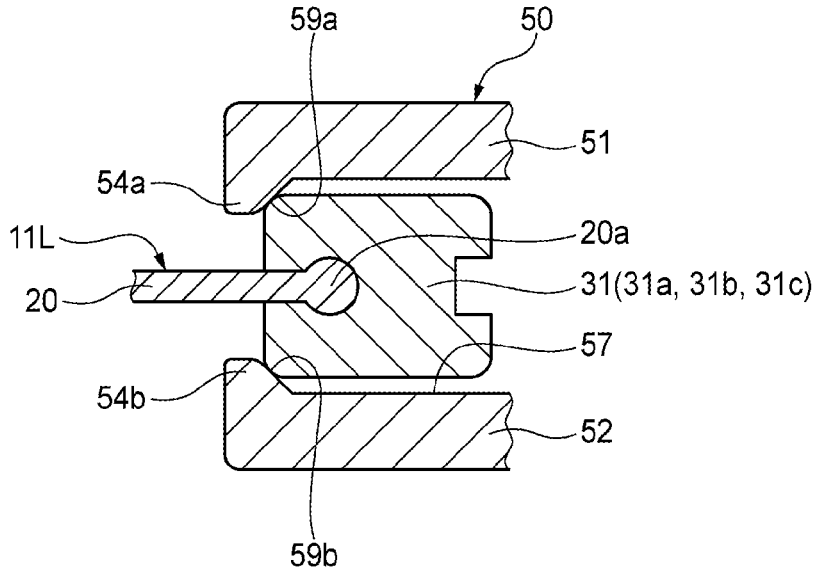
FIG. 11 is a partial cross-sectional view illustrating a state in which the element of the separation-side fastener stringer comes in contact with a flange of the slider.
Figure 12:
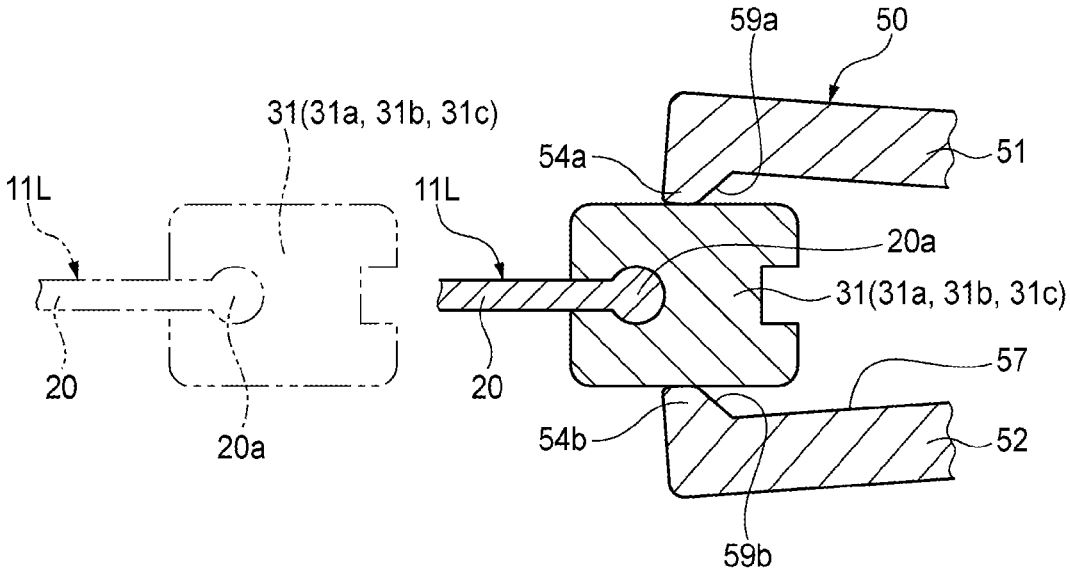
FIG. 12 is a partial cross-sectional view illustrating a state in which the element in FIG. 11 bends the upper blade and a lower blade and then gets out of the slider.

As illustrated in FIGS. 2 and 4, inner surfaces of the upper and lower flanges 54*a* and 54*b* at the left side of the body 50 in the width direction are formed as inclined surfaces 59*a* and 59*b* in which the thickness thereof gradually increases as it extend from the inside to the outside in the width direction. For this reason, as illustrated in FIG. 11, as upper and lower corner portions of each fastener element 31 of the separation-side fastener stringer 11L applied with the lateral pulling force abut against the inclined surfaces 59*a* and 59*b* of the upper and lower flanges 54*a* and 54*b*, the lateral pulling force is efficiently transmitted to the upper blade 51 and lower blade 52 through the inclined surfaces 59*a* and 59*b*. Therefore, as illustrated in FIG. 12, since a gap between the upper and lower flanges 54*a* and 54*b* is easily widened, it is possible to easily separate the separation-side fastener stringer 11L from the slider 40.

Figure 7:
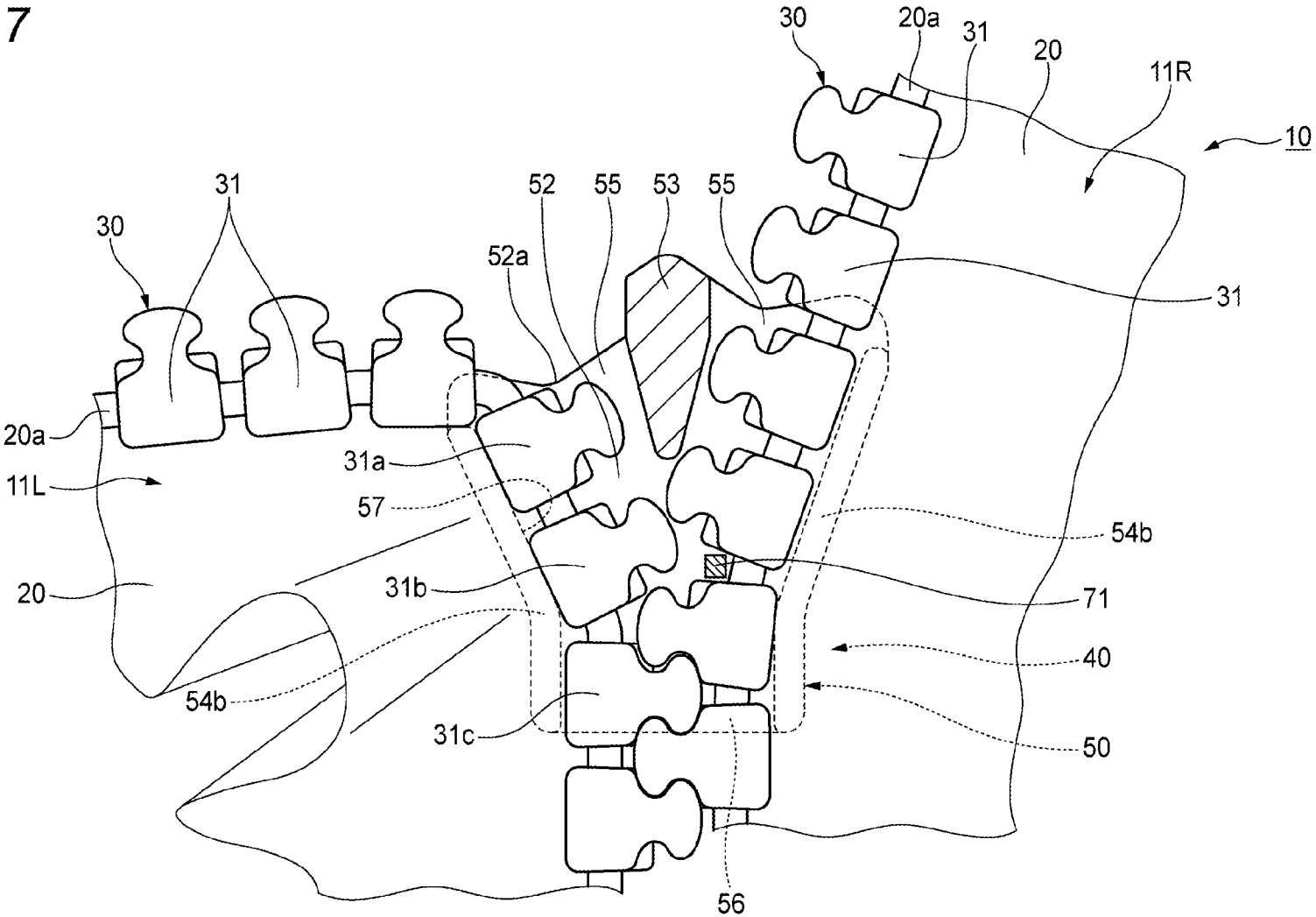
FIG. 7 is an enlarged front view illustrating a state in which a lateral pulling force is applied to the slide fastener shown in FIG. 6.
Figure 8:
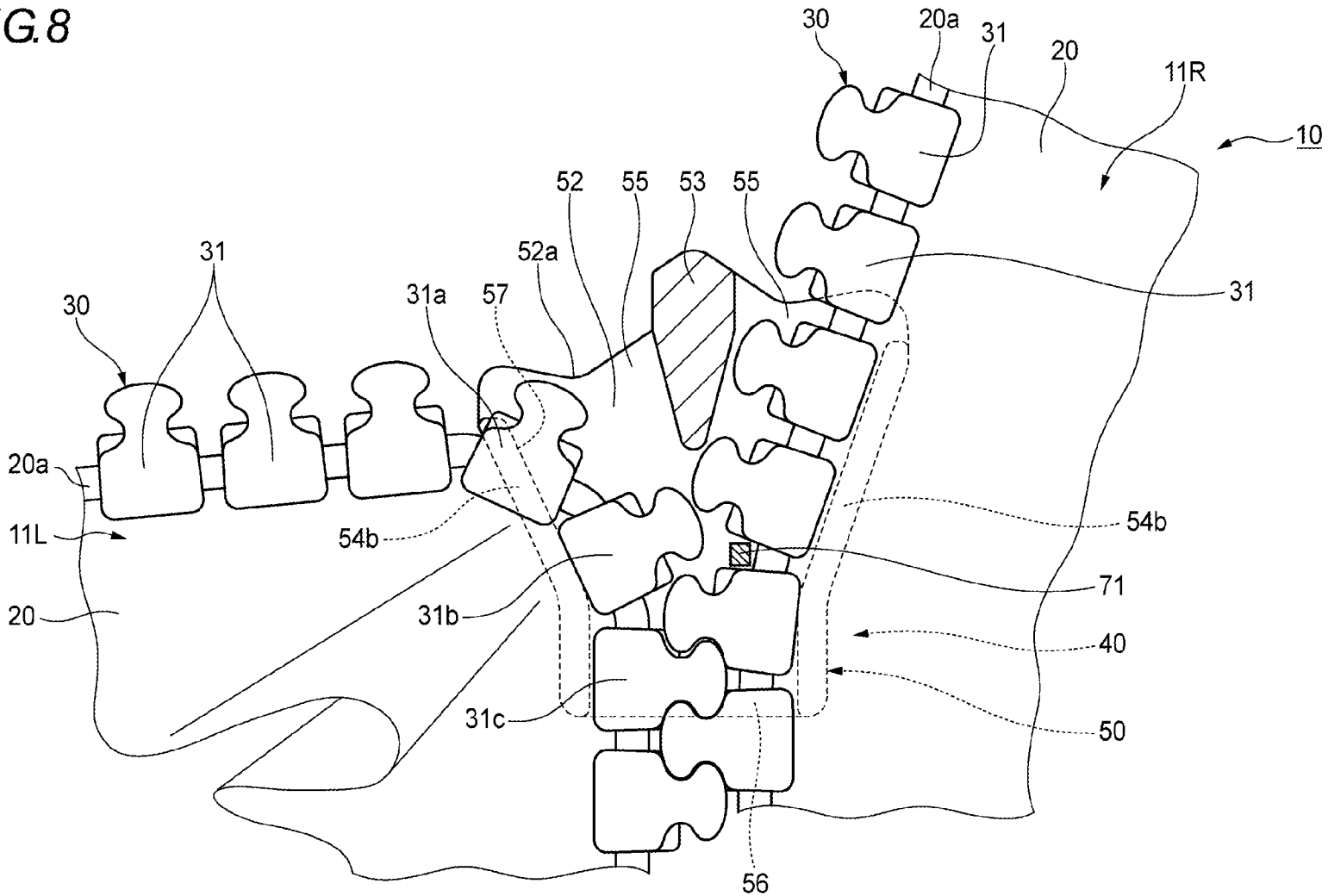
FIG. 8 is an enlarged front view illustrating a state in which elements of a separation-side fastener stringer shown in FIG. 7 start getting out of the slider.
Figure 9:
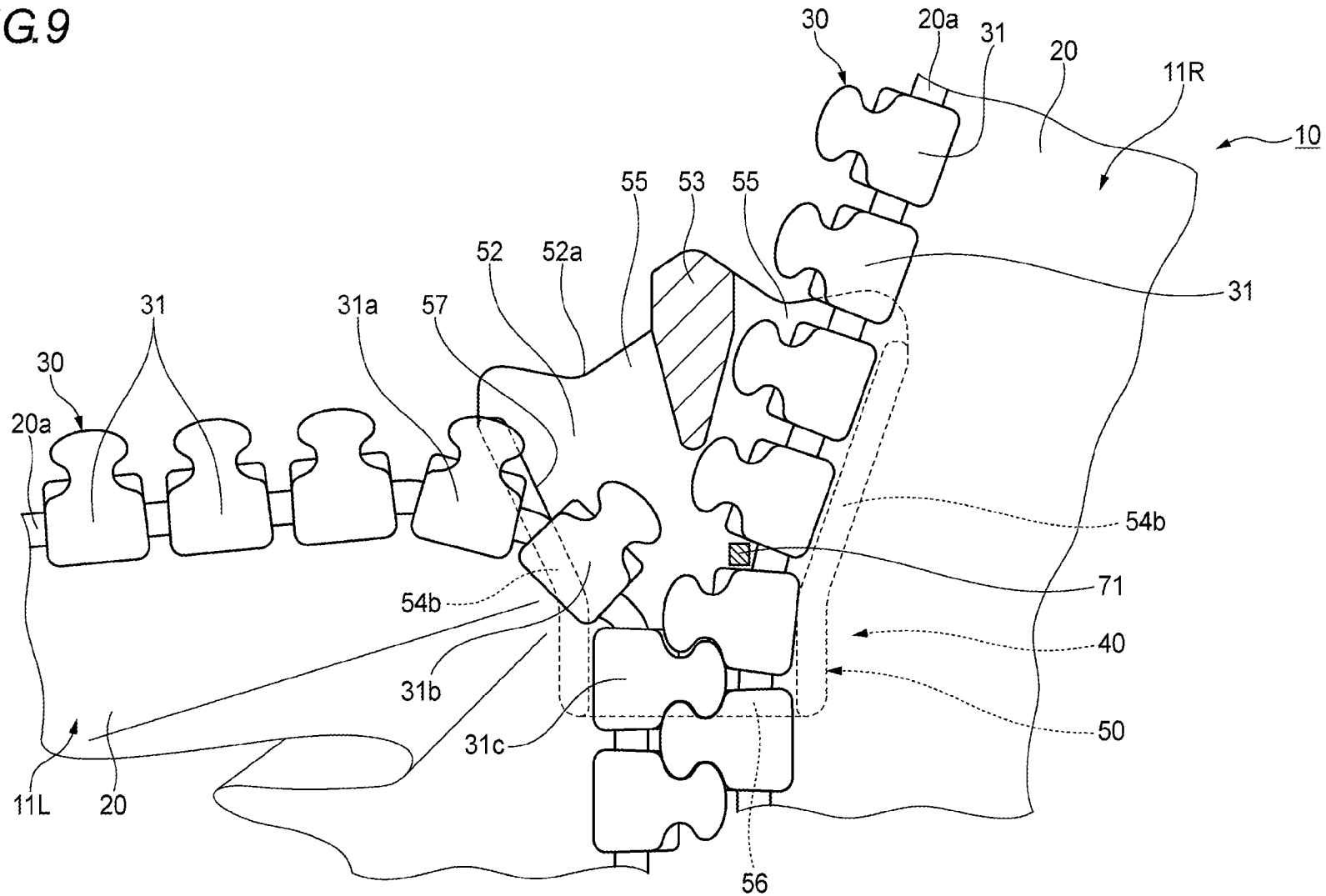
FIG. 9 is an enlarged front view illustrating a state in which the elements shown in FIG. 8 further get out of the slider.
Figure 10:
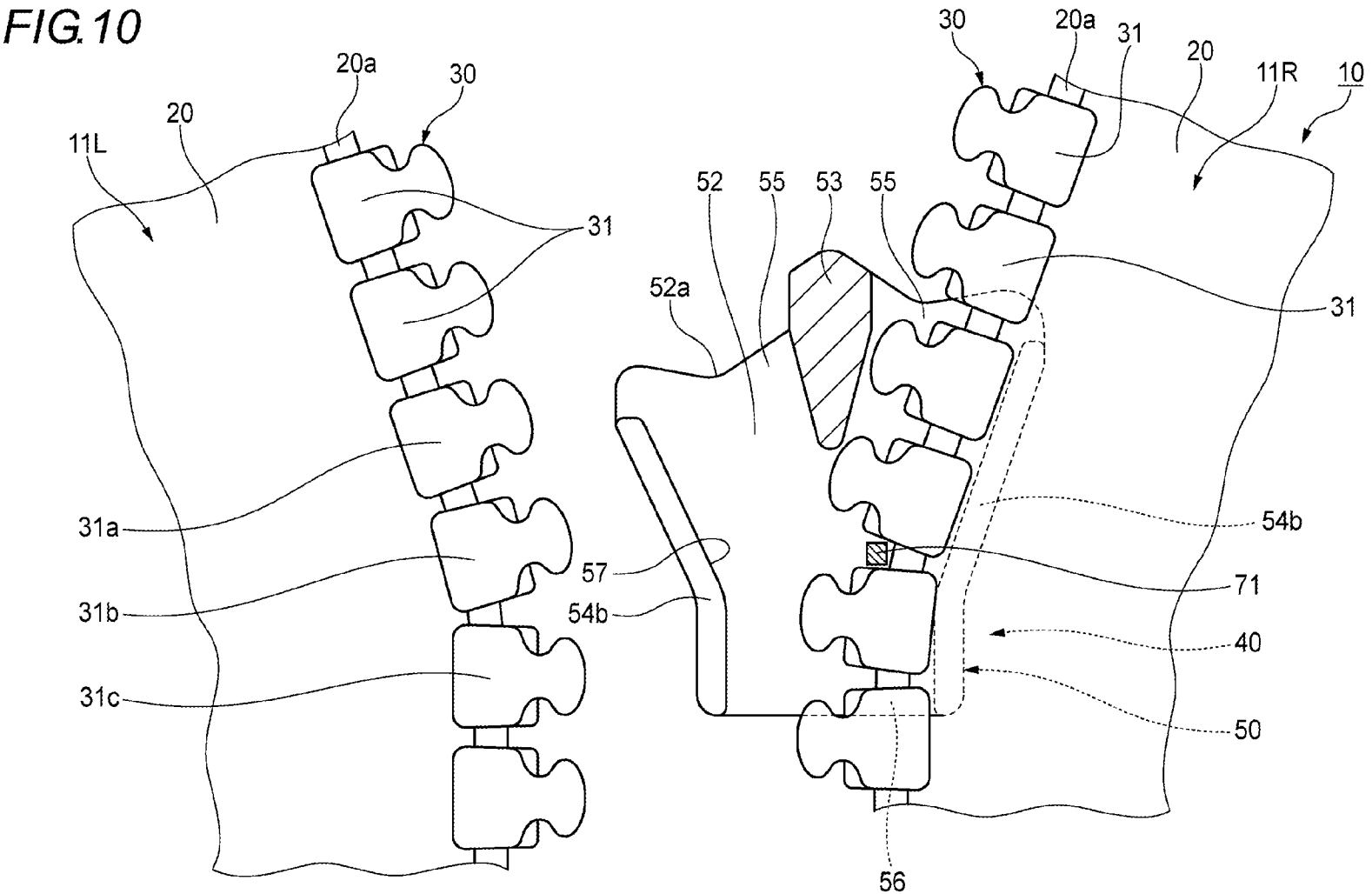
FIG. 10 is an enlarged front view illustrating a state in which the elements in FIG. 9 fully get out of the slider.

With the slide fastener 10 having the above configuration, as the lateral pulling force directed outward in the width direction is applied to the pair of left and right fastener stringers 11L and 11R (see FIG. 7), the first fastener element 31*a* (fastener element 31) of the separation-side fastener stringer 11L, which is positioned closest to the shoulder mouth 55 inside the element guide passage 57 and thus is not engaged, abuts against each of the inclined surfaces 59*a* and 59*b* of the upper and lower flanges 54*a* and 54*b* (see FIG. 11) to widen the gap between the upper and lower flanges 54*a* and 54*b*. Simultaneously, the first fastener element 31*a* bends the left portions of the upper blade 51 and lower blade 52 with respect to the guide post 53 (see FIGS. 8, 9 and 12), so that the first fastener element gets out of the slider 40. Subsequently to the first fastener element 31*a*, the second and third fastener elements 31*b* and 31*c* get out of the slider 40 in the same manner as the first fastener element 31*a*, so that the separation-side fastener stringer 11L is separated from the slider 40 (see FIG. 10).

As described above, according to the slide fastener 10 of this embodiment, since the cutaway portions 51*a* and 52*a* extending outward in the width direction from the front lateral surface 53*a* at the left side of the guide post 53 are respectively formed on the upper blade 51 and the lower blade 52, the left side of the upper blade 51 and the lower blade 52 with respect to the guide post 53 can be easily bent. Accordingly, it is possible to easily separate the separation-side fastener stringer 11L from the slider 40 with the simple structure.

Figure 13:
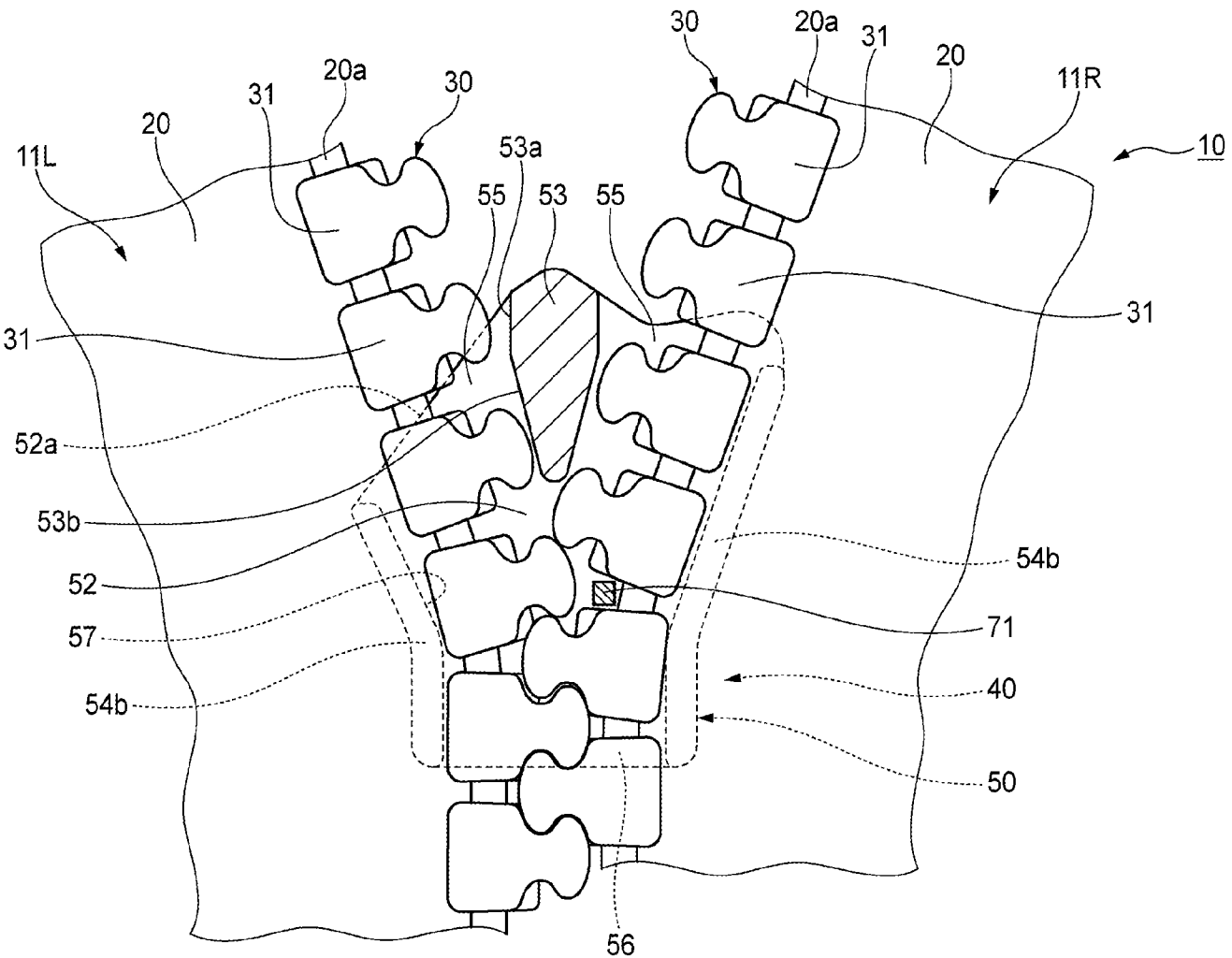
FIG. 13 is an enlarged front view corresponding to FIG. 6 to illustrate a modification of the slide fastener according to the present invention.

As a modification of this embodiment, as illustrated in FIG. 13, the cutaway portions 51*a* and 52*a* of the upper blade 51 and the lower blade 52 may be extended rearward further than the rear end of the guide post 53, so that the front ends of the upper and lower flanges 54*a* and 54*b* at the left side of the body 50 are positioned at the rear side with respect to the rear end of the guide post 53. Also, the cutaway portions 51*a* and 52*a* of this modification extend, in a liner fashion, outward in the width direction and rearward an in an oblique manner from the front end of the forward lateral surface 53*a* at the left side of the guide post 53.

According to this modification, since the length of the upper and lower flanges 54*a* and 54*b* at the left side of the body 50 in the longitudinal direction is shorter than that of the above embodiment, the left side of the upper blade 51 and the lower blade 52 with respect to the guide post 53 are likely to be bent, so that it is possible to easily separate the separation-side fastener stringer 11L from the slider 40.

Although the present invention is not limited to the above-described embodiment, and can be properly modified or revised without deviating from the gist of the present invention. For example, the embodiment illustrates the case where the present invention is applied to the slider having the automatic stop function, but the present invention is not limited thereto. The present invention may be applied to a slider with no automatic stop function, in which a pull tab attachment post for attaching the pull tab 60 thereto is installed upright at the portions of the front attachment posts 58F and the rear attachment posts 58R, instead of the front and rear attachment posts.

Figure 14:
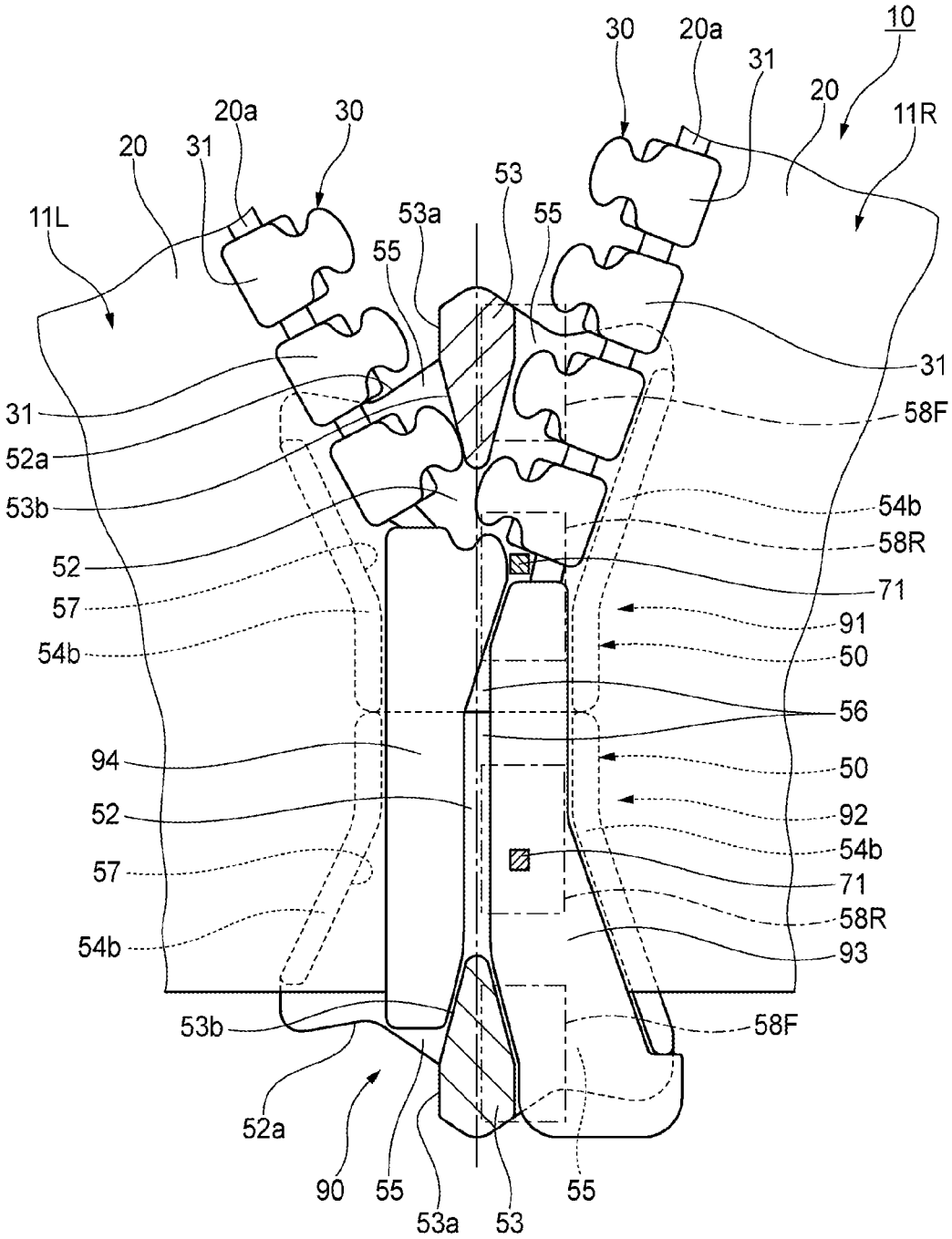
FIG. 14 is an enlarged front view of a state in witch the upper blade is cut away, to illustrate a case where the present invention is applied to a slide fastener with a reverse separable end stop.

The embodiment illustrates that the separable end stop 13 are formed at the lower end portions of the pair of left and right fastener tapes 20, but the present invention is not limited thereto. As illustrated in FIG. 14, a reverse separable end stop 90 may be installed, instead of the separable end stop 13. The reverse separable end stop 90 includes an upper slider 91 having the same configuration as the slider 40, a lower slider 92 installed at a lower side of the upper slider 91 such that the rear mouths 56 face each other, a box pin 93 formed at the lower end portion of the tape-side edge 20*a* of the right fastener tape 20, and an insert pin 16 which is formed at the lower end portion of the tape-side edge 20*a* of the left fastener tape 20 and is able to be inserted into the upper slider 91 and the lower slider 92.

If the upper slider 91 is moved upward (in a direction away from the lower slider 92) in the reverse separable end stop 90, the pair of left and right fastener element rows 30 which are in the separated state are engaged with each other. If the upper slider 91 is moved downward (in a direction approaching the lower slider 92), the pair of left and right fastener element rows 30 which are in the engaged state are disengaged from each other. If the lower slider 92 is moved upward (in a direction approaching the upper slider 91), the pair of left and right fastener element rows 30 which are in the engaged state are disengaged from each other. If the lower slider 92 is moved downward (in a direction away from the upper slider 91), the pair of left and right fastener element rows 30 which are in the separated state are engaged with each other.

Comparing the lower slider 92 with the upper slider 91, when the front side of the lower slider 92 in the front and rear direction is set as the guide post 53, the cutaway portions 51*a* and 52*a*, the claw insertion hole 51*b*, the front and rear attachment posts 58F and 58R, the upper and lower flanges 54*a* and 54*b* having the short length in the front and rear direction, and the inclined surfaces 59*a* and 59*b* are disposed symmetrically in the left and right direction.

At both sides of the upper and lower sliders 91 and 92 in the reverse separable end stop 90, the fastener elements 31 are able to be separated from the gap between the upper and lower flanges 54*a* and 54*b* at the side (at the side of separation-side fastener stringer 11L) in which the insert pin 94 is inserted.

DESCRIPTION OF REFERENCE NUMERALS

10: Slide Fastener
11L: Fastener Stringer (Separation-Side Fastener Stringer)
11R: Fastener Stringer (Stationary-Side Fastener Stringer)
20: Fastener Tape
20*a*: Tape-Side Edge
30: Fastener Element Row
31: Fastener Element
40: Slider
50: Body
51: Upper Blade
51*a*: Cutaway Portion
52: Lower Blade
52*a*: Cutaway Portion
53: Guide Post

53*a:* Front Lateral Surface
54*a:* Upper Flange
54*b:* Lower Flange
58F: Front Attachment Post (Pull Tab Attachment Portion)
58R: Rear Attachment Post (Pull Tab Attachment Portion)
60: Pull Tab
70: Stopper Claw Body (Pull Tab Attachment Portion)
80: Pull Tab Holding Cover (Pull Tab Attachment Portion)
100: Slider

The invention claimed is:

1. A slide fastener comprising:

a pair of fastener stringers provided with fastener element rows having a plurality of fastener elements along opposing tape-side edges of a pair of fastener tapes; and a slider slidably attached to the fastener element rows to engage and disengage the fastener elements, wherein one of the fastener stringers is separated from the slider when a lateral pulling force directed outward in a width direction of the fastener tapes is applied to the pair of fastener stringers, wherein the slider includes:

a body having an upper blade and a lower blade which are disposed in parallel while being spaced apart from each other in an up-down direction, a guide post connecting the upper blade and the lower blade at front ends thereof, flanges each provided along both left and right edges of the upper blade and the lower blade, and a pull tab attachment portion provided on an upper surface of the upper blade; and a pull tab rotatably attached to the pull tab attachment portion, and wherein the upper blade and the lower blade are provided with cutaway portions at portions outward in the width direction from one lateral surface of the guide post so that an outer shape of each of the upper blade and the lower blade is asymmetric in the width direction, wherein a dimension, in the up-down direction, of a gap between a first upper flange of the flanges, provided along one of the left and right edges of the upper blade, and a first lower flange of the flanges, provided along one of the left and right edges of the lower blade, is greater than a dimension, in the up-down direction, of a gap between a second upper flange of the flanges, provided along another one of the left and right edges of the upper blade, and a second lower flange of the flanges, provided along another one of the left and right edges of the lower blade.

2. The slide fastener according to claim 1, wherein the cutaway portions are formed so as to extend outward in the width direction from the one lateral surface of the guide post.

3. A slide fastener comprising:

a pair of fastener stringers provided with fastener element rows having a plurality of fastener elements along opposing tape-side edges of a pair of fastener tapes; and a slider slidably attached to the fastener element rows to engage and disengage the fastener elements, wherein one of the fastener stringers is separated from the slider when a lateral pulling force directed outward in a width direction of the fastener tapes is applied to the pair of fastener stringers, wherein the slider includes:

a body having an upper blade and a lower blade which are disposed in parallel while being spaced apart from each other in an up-down direction, a guide post connecting the upper blade and the lower blade at front ends thereof, flanges each provided along both left and right edges of the upper blade and the lower blade, and a pull tab attachment portion provided on an upper surface of the upper blade; and a pull tab rotatably attached to the pull tab attachment portion, and wherein the upper blade and the lower blade are provided with cutaway portions at portions outward in the width direction from one lateral surface of the guide post, wherein a length, in a longitudinal direction, of the flanges at one side of the body in the width direction is shorter than that of the flanges at another side of the body in the width direction, and wherein a dimension, in the up-down direction, of a gap between a first upper flange of the flanges, provided along one of the left and right edges of the upper blade, and a first lower flange of the flanges, provided along one of the left and right edges of the lower blade, is greater than a dimension, in the up-down direction, of a gap between a second upper flange of the flanges, provided along another one of the left and right edges of the upper blade, and a second lower flange of the flanges, provided along another one of the left and right edges of the lower blade.

4. A slide fastener comprising:

a pair of fastener stringers provided with fastener element rows having a plurality of fastener elements along opposing tape-side edges of a pair of fastener tapes; and a slider slidably attached to the fastener element rows to engage and disengage the fastener elements, wherein one of the fastener stringers is separated from the slider when a lateral pulling force directed outward in a width direction of the fastener tapes is applied to the pair of fastener stringers, wherein the slider includes:

a body having an upper blade and a lower blade which are disposed in parallel while being spaced apart from each other in an up-down direction, a guide post connecting the upper blade and the lower blade at front ends thereof, flanges each provided along both left and right edges of the upper blade and the lower blade, and a pull tab attachment portion provided on an upper surface of the upper blade; and a pull tab rotatably attached to the pull tab attachment portion, and wherein the upper blade and the lower blade are provided with cutaway portions at portions outward in the width direction from one lateral surface of the guide post, wherein a distance, in a longitudinal direction, between a rear end of the guide post and front ends of the flanges at one side of the body in the width direction is shorter than a distance, in the longitudinal direction, between the rear end of the guide post and front ends of the flanges at another side of the body in the width direction, and wherein a dimension, in the up-down direction, of a gap between a first upper flange of the flanges, provided along one of the left and right edges of the upper blade, and a first lower flange of the flanges, provided along one of the left and right edges of the lower blade, is greater than a dimension, in the up-down direction, of a gap between a second upper flange of the flanges, provided along another one of the left and right edges of the upper blade, and a second lower flange of the flanges, provided along another one of the left and right edges of the lower blade.

* * * * *